United States Patent [19]

Grint

[11] Patent Number: 4,503,692

[45] Date of Patent: Mar. 12, 1985

[54] PROTECTIVE DOORKNOB ENCASEMENT DEVICE

[76] Inventor: Dean R. Grint, 5605 Goodway Dr., Salt Lake City, Utah 84107

[21] Appl. No.: 410,424

[22] Filed: Aug. 23, 1982

[51] Int. Cl.[3] ..... E05B 17/14

[52] U.S. Cl. ..... 70/418; 70/417; 70/424; 70/455; 292/DIG. 2

[58] Field of Search ..... 70/418, 417, 416, 423, 70/424, 455, 54, 56, DIG. 58; 292/346, 347, 341.18, 341.19, DIG. 2, DIG. 13, DIG. 53; 248/221.3, 221.4, 222.1, 223.4, 224.1

[56] References Cited

U.S. PATENT DOCUMENTS

| | | | |
|---|---|---|---|
| 2,458,002 | 1/1949 | Kaskouras . | |
| 3,210,972 | 10/1965 | Johnson . | |
| 3,444,712 | 5/1969 | Greenwald | 70/423 |
| 3,660,996 | 5/1972 | Syvertson | 70/DIG. 58 X |
| 3,696,646 | 10/1972 | Loscalzo | 70/419 X |
| 3,976,318 | 8/1976 | Krus . | |
| 4,084,414 | 4/1978 | Martin | 292/347 X |
| 4,106,315 | 8/1978 | Dohanyos | 70/56 |
| 4,127,967 | 12/1978 | Franzl . | |
| 4,254,931 | 3/1981 | Aikens et al. | 248/222.1 X |

FOREIGN PATENT DOCUMENTS

WO83/01641 5/1983 PCT Int'l Appl. ..... 70/448

*Primary Examiner*—Gary L. Smith
*Assistant Examiner*—Russell W. Illich
*Attorney, Agent, or Firm*—Thorpe, North and Western

[57] ABSTRACT

A protective doorknob encasement device which provides a protective cover over the space formed between a door jamb and an exterior doorknob to prevent insertion of a tool to forcibly open the door. The invention includes a mounting plate and a track guide to enable slidable attachment of a protective casement. The track guide is configured so as to orient and restrict movement of the casement along the track and only in a direction toward the exterior door surface. Removal of the casement is permitted by its continued forward motion along the track and is only possible when the door is open. This unidirectional forward motion results from use of spring-biased pawls coupled to the casement which catch in corresponding grooves set in the mounting plate to prevent rearward motion. An opening is provided in the casement in alignment with a key slot of the enclosed doorknob to permit normal access.

9 Claims, 4 Drawing Figures

PROTECTIVE DOORKNOB ENCASEMENT DEVICE

BACKGROUND OF THE INVENTION

1. Field of the Invention.

This invention relates to protective doorknob devices. More particularly, the invention is directed to a doorknob encasement device mounted to a door jamb which protects the doorknob from forceable removal.

2. Description of the Prior Art.

In order to prevent intruders and burglars from unauthorized entry through a locked door where the lock is mounted in the doorknob of the door, previous patents have described protective devices mounted directly over the doorknob or attached directly to the door and resting on or over the doorknob. U.S. Pat. No. 3,210,972 illustrates a door handle cover with no means of attachment directly to the door. The utility of the device depends on the use of a key for its removal in order to give access to the doorknob. Although such a device may make the house or building secure from all those having a key to the doorknob, the door handle remains free-standing and thus subject to unauthorized and forceful entry by removal of the doorknob with its protective door handle cover. The single unit door handle cover would also fail to protect from entry by means of an instrument inserted between the space defined by the unprotected door jamb and door and adjacent to the doorknob. Other protective door handle covers such as U.S. Pat. No. 2,458,002 function in similar manner, but have different means to release the door handle cover to gain access to the doorknob itself.

U.S. Pat. No. 3,976,318 teaches a device which acts as a burglar-proof lock protector. It consists of two separate and unattached parts which cover and protect a deadbolt lock from forced entry. However, this invention is permanently fixed in place and is not suitable for protection of a doorknob where removal is required to provide access for turning the handle.

OBJECTS AND SUMMARY OF THE INVENTION

It is therefore an object of the present invention to provide a protective encasement device for an exterior doorknob and lock having a casement slidably attached to the door jamb.

It is also an object of the present invention to provide a protective cover over the space adjacent to the doorknob between the door jamb and the door to prevent forceful entry without the use of a key.

It is a further object of the present invention to provide a protective doorknob encasement device which is protective of the doorknob and adjacent the door space opening, yet is easily removed by one entering the exterior door by key.

These and other objects are realized in a protective doorknob encasement device which includes a mounting plate affixed to the door jamb. The mounting plate includes a single or plural track guide forming a track directionally oriented toward the exterior door surface. A protective casement is slidably and unidirectionally mounted onto the track by means of single or plural flanges, or gripping tracks, affixed to or formed as part of the casement. The casement configuration operates to enclose the doorknob, but has two openings to allow for proper positioning. The first opening is at the back side of the casement and is configured for close contact against the surface of the door around the doorknob, leaving no room for the insertion of devices or instruments used for means of unauthorized intrusion. The second opening is positioned forward in the casement so as to provide access to a key slot of the enclosed doorknob. The device is slid into position on the track guide until it seats against the door around the doorknob. The second opening aligns with the key slot of the protected doorknob. The encasement device may be removed by its further unidirectional forward advancement along the track guide means when the door is opened and no longer blocks its progress. The casement movement is restricted to unidirectional forward motion by spring-biased means coupled to the casement. The interaction of the spring-biased means with grooves in the mounting plate prevents reverse movement, allowing only unidirectional track motion toward the surface of the door.

One unusual and surprising result of the present invention is that because of the small opening for keyed entry, even an unlocked and closed door is protected because it can only be opened by the use of a key. Therefore, protection extends to both locked and unlocked situations.

Other objects and features will be obvious to a person skilled in the art from the following detailed decription, taken with the accompanying drawings.

DETAILED DESCRIPTION OF THE DRAWINGS

DETAILED DESCRIPTION OF THE INVENTION

Figure 1:
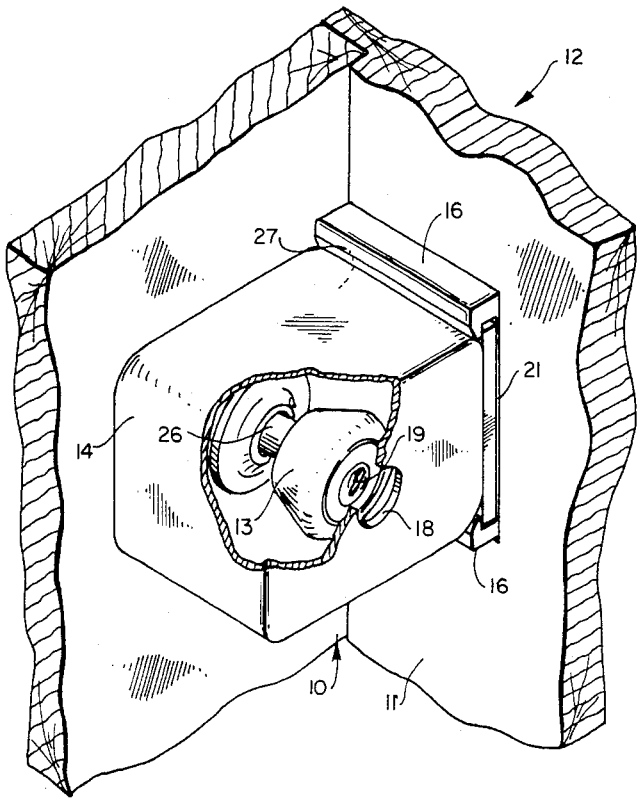
FIG. 1 is a partially broken-away view of the subject invention mounted in close contact with the surface of a closed exterior door, showing a doorknob disposed within the housing of the device.

FIGS. 1–4 disclose one embodiment of the subject invention. The protective doorknob encasement device 10 is shown generally in FIG. 1 having a mounting plate 21 onto which is attached a pair of track guides 16 having a track direction oriented toward the exterior door surface 12. In the disclosed embodiments, the track guides comprise upper and lower figures projecting toward the center of the plate to form track channels.

A casement 14 is mounted onto the track guide means 16 by means of affixed gripping tracks 15. The casement 14 is adapted for enclosing a doorknob 13 as is shown in the partial cut-away view in FIG. 1. By means of and due to the configuration of the first doorknob encasement opening 27, located at the back side of the casement 4, when properly mounted and oriented, the casement 14 encloses the doorknob 13 and seats in close contact with the surface of the exterior door 12. Such close contact with the exterior door surface 12 is accomplished by means of the unidirectional sliding movement provided by the track guide means 16 and gripping track 15 in concert with spring-biased means 23 which prevent rearward motion. Accordingly, the casement is free to move forward (unidirectionally) unless blocked by contact with the door surface 12.

The casement 14 also contans a second or key slot opening 18 which, when said casement 14 is properly positioned, is configured so as to provide access of a key to the doorknob key slot 19. The cut-away perspective of the casement 14 further reveals the doorknob shaft 26 disposed within it, attaching the doorknob 13 to the exterior door 12.

The protective doorknob encasement device 10 both encases and protects the doorknob 13 when the casement 14 is slidably mounted in its protective and proper position immediately adjacent to the exterior door 12 as shown in FIG. 1. This close contact prevents intrusive entry by someone wishing to forcefully remove the doorknob 13. Another important part of the protective nature of the protective doorknob encasement device 10 is that due to its unique positioning on the door jamb 11 by means of the mounting plate 21, the track guide means 16, and gripping tracks 15, it is not only properly oriented with respect to the doorknob 13 for which it is a protection, but it also acts as a cover for the space immediately between the doorknob 13 and the door jamb 11.

Figure 2:
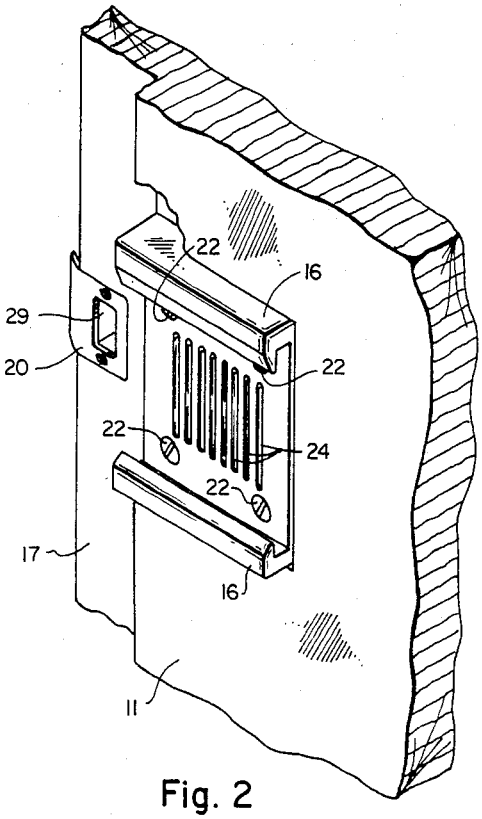
FIG. 2 is a horizontal cross-sectional view of the mounting plate affixed to the door jamb, taken along lines 2-2 of FIG. 1.
Figure 3:
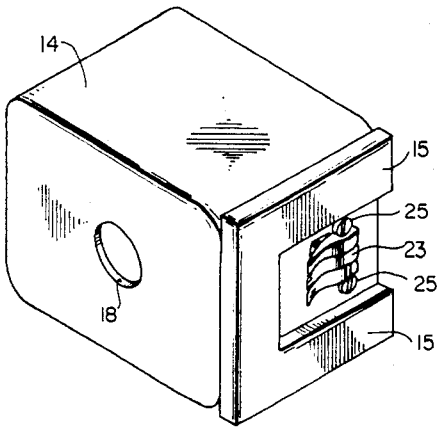
FIG. 3 is a perspective view of the detached casement.

FIG. 2 shows the mounting plate 21 and the track guide 16 onto which may be mounted the casement 14. FIG. 3 shows the detached casement 14, the gripping tracks 15, and the spring-biased pawls which restrict movement of the casement 14 to unidirectional forward motion as they interact with grooves 24 once said casement 14 is properly mounted in its protective position. The mounting plate 21, casement 14, mounting track guide 16, gripping tracks 15 and their component parts, together comprise the protective doorknob encasement device 10.

In FIG. 2, a mounting plate 21 is rigidly affixed to the door jamb 11 by bolts 22 or any one of numerous means obvious to one skilled in the art. The mounting plate 21 has several important functions. It acts as a mounting support for the casement 14. This mounting function is accomplished by welding or otherwise mechanically attaching a single or plural track guide means 16 to the mounting plate 21, in a direction oriented toward the exterior door surface 12. The casement 14 is then slidably mounted onto the track guide means 16 by means of corresponding single or plural gripping tracks 15 which are mechanically or otherwise attached to casement 14 as shown in FIG. 3.

One reason for the placement of the mounting plate 21 on the door jamb 11, as shown in FIG. 2, is to properly position the track guide mounted casement 14 over the doorknob 13 without actual attachment to the door. FIG. 1 shows the casement 14 properly mounted and adjusted so as to rest adjacent to the exterior door 12. By these slide mounting means, the casement 14 and the two casement openings 27 and 18 are properly oriented with respect to the doorknob 13, the door 12, and the key slot 19. The proper positioning of the protective doorknob encasement device 10 by reason of the mounting plate 21, as well as properly positioned and affixed track means 15 and 16, will not allow entry through the closed or locked exterior door 12 by means other than by a key.

Access of a key to the doorknob 13 is only gained by means of the second opening, or key slot opening 18, as seen in FIG. 3. The key slot opening 18 by its size makes it difficult or impossible to turn the doorknob 13, other than by the use of a key. Another unusual result, therefore, is that even an unlocked, closed door 12 which is only latched must be opened by key when the protective doorknob encasement device 10 is properly and protectively positioned. Keyed entry may be obtained by inserting a key into the key slot 19, turning it, unlocking the lock mounted in the doorknob 13 attached to the doorknob shaft 26 and causing the latch tongue to retract from its resting position in the strike plate 20, shown in FIG. 2.

Figure 4:
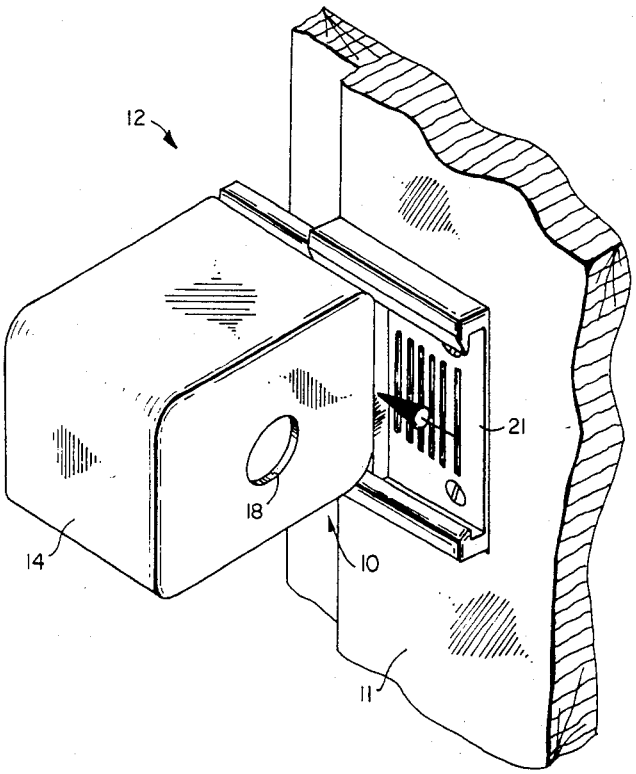
FIG. 4 is a perspective view of the subject invention mounted on the mounting plate, with the door ajar, and phantom lines representing the unidirectional movement of the removal of the invention, said direction being toward the door surface.

Another function of the mounting plate 21 is not only to aid in the forward mounting movement of the casement 14 toward the exterior door 12, but also to prevent the reverse movement of the casement 14 away from the exterior door 12. FIG. 4, by the use of phantom lines, indicates the forward, unidirectional movement of the casement 14 by means of the gripping tracks 15 along the track guide means 16, mounted on the mounting plate 21. This forward progress of the casement 14 may be adjustably stopped prior to or in close contact with the closed exterior door 12, as shown in FIG. 1. The casement'complete removal is slidably accomplished by the continued unidirectional movement along the track guide means 16 when the door 12 is opened, as seen in FIG. 4, by use of the phantom lines. Reverse removal of the casement 14 along the track guide means 16 is prohibited by single or plural spring-biased pawls 23 attached by attachment means 25 to the casement 14. The single or plural pawls 23 act to stop reverse motion by catching in catch means or grooves 24 or other means obvious to one skilled in the art for preventing the reverse motion of the pawls 23. FIGS. 2 and 3 respectively show the grooves 24 set into and part of the mounting plate 21, and the single or plural pawls 23 attached to the casement 14, which come into contact with the grooves 24 as the casement 14 is mounted onto the track guide means 16 and forward movement is commenced.

An additional protective feature of the properly positioned device as shown in FIG. 1 involves the limitation of access to the sliding latch of the doorknob. Specifically, the mounting plate 21 operates to block entry of a knife blade or other manipulative device between the closed door edge and striker plate 20 fixed to the door jamb 17 (see FIG. 2). Therefore, the intruder is frustrated because he can neither trip the latch free from the recess 29 of the stricken plate 20, nor can he pry the doorknob free and thereby gain access. This combination of features presents an unusual and striking benefit over prior art security devices.

It will be apparent to those skilled in the art that modifications to this structure may be incorporated without departing from the inventive concepts disclosed herein. For example, the means of attachment of the track gripping 15 and guiding means 16, as well as the attachment of the pawls 23 to the casement 14, may be accomplished by use of screws, or by welding or other sturdy and durable means. Furthermore, these elements can be reversed in location of attachment. Also, the number of track guide means 16 and the corresponding gripping tracks 15 may be single or plural in number, provided room remains on the mounting plate 21 and on the casement 14 to allow for the placement of the spring-biased pawls 23 and the grooves 24 necessary to prevent reverse motion and thus keep the protective nature of the device intact. Variations may also arise in the size and form of the openings in the casement through which the key is passed to operate and open the door 12, by the key slot 19, and the opening 27 through which the doorknob 13 passes as the casement 14 is slidably, unidirectionally mounted on the track guide means 16 may also vary in its size and configuration so long as the casement 14 is configurated so as to rest in close contact with the door 12 and protect the doorknob 13.

Accordingly, the scope of the invention is not to be limited by the examples set forth herein, but is to be construed in accordance with the following claims.

I claim:

1. A protective doorknob encasement device for enclosing a doorknob when said device is positioned so as to rest adjacent to an exterior surface of a door, comprising: a mounting plate adapted in size and configuration for attachment to a doorjam supporting the door, said plate being adapted for an approximate perpendicular orientation with respect to the door, said mounting plate including means for rigid fixation to the doorjam;

a trackguide means affixed to said mounting plate and oriented thereon for providing a track having a movement direction toward said exterior door surface;

a protective casement having a structure adapted for enclosing a doorknob at the exterior surface of said door when properly mounted on said track, said casement having (i) a first opening at a back side thereof adapted to pass around a doorknob to be enclosed and configured for close contact against said door and around said doorknob for preventing access to said doorknob by unauthorized intruders, and (ii) a second forward opening positioned in the casement so as to provide access to a key slot fo the enclosed doorknob;

means coupled to the casement and extending between respective planes containing the first and second openings, said coupling means extending along a plane at approximate right angles to said respective planes for slideably mounting said casement onto said trackguide means to enable an orientation of (i) close contact of said first casement opening with the exterior surface of said door and around said knob, and (ii) access to said key slot through said second opening; and unidirectional advancement means coupled to said casement and including means for restricting said casement movement along said trackguide to forward tracking motion at approximate right angles to the exterior surface of the door when it is in a closed position at the doorjam.

2. A protective doorknob encasement device according to claim 1 wherein said track guide means includes a plurality of tracks adapted for substantial perpendicular orientation to the door.

3. A protective encasement device according to claim 1 wherein said track guide means is free of obstructions to forward movement, thus enabling removal of said device when said door is opened.

4. A protective doorknob encasement device as defined in claim 1 wherein the mounting plate comprises a piece of rigid metal, and said track guide means comprises upper and lower flanged edges which project toward the center of the plate to thereby form slotted track sections for receiving said means for slidably mounting said casement thereon.

5. A protective doorknob encasement device according to claim 1 wherein said unidirectional advancement means comprises spring-biased means coupled to said casement.

6. A protective doorknob encasement device according to claim 5 wherein said spring-biased means comprise pawls.

7. A protective doorknob encasement device according to claim 5 wherein said spring-biased means for restricting movement of said casement to forward tracking motion along said track guide means comprise catch means in said mounting plate.

8. A protective doorknob encasement device according to claim 7 wherein said catching means in said mounting plate are grooves.

9. A protective doorknob encasement device according to claim 1 wherein said device and all component parts are made of material resistant to forceful entry by means other than a key, to prevent the entry of intruders or any other unauthorized persons.

* * * * *